US005499743A

United States Patent [19]

Blumenkron

[11] Patent Number: 5,499,743

[45] Date of Patent: Mar. 19, 1996

[54] FLEXIBLE TANK FOR LIQUIDS

[76] Inventor: Jorge L. Blumenkron, 12 sur No. 2916, Colonia Mirador, 72530 Puebla. Pue, Mexico

[21] Appl. No.: 207,170

[22] Filed: Mar. 8, 1994

[30] Foreign Application Priority Data

Mar. 15, 1993 [DE] Germany ..... 9303805 U

[51] Int. Cl.[6] ..... B65D 35/14

[52] U.S. Cl. ..... 222/107; 222/482; 220/4.13; 220/450; 220/461; 220/465; 383/110; 383/113

[58] Field of Search ..... 222/107, 181, 222/185, 482, 185.1, 181.2; 220/450, 453, 461, 465, 565, 4.13; 383/92, 110

[56] References Cited

U.S. PATENT DOCUMENTS

| | | | |
|---|---|---|---|
| 3,266,170 | 8/1966 | Reeves | 383/92 |
| 3,567,074 | 3/1971 | Brown | 222/107 |
| 4,194,652 | 3/1980 | Williamson et al. | 222/181 X |
| 4,573,508 | 3/1986 | Knaus | 220/453 X |
| 4,714,178 | 12/1987 | Bohl et al. | 222/107 |
| 4,854,481 | 8/1989 | Bohl et al. | 222/107 X |
| 4,865,891 | 9/1989 | Larsson | 220/450 X |
| 4,881,646 | 11/1989 | Weber | 383/110 X |
| 5,115,947 | 5/1992 | McDonnell et al. | 222/107 |
| 5,188,266 | 2/1993 | Loulias | 383/110 X |
| 5,248,063 | 9/1993 | Abbott | 222/107 |

*Primary Examiner*—John Rivell
*Attorney, Agent, or Firm*—Oblon, Spivak, McClelland, Maier & Neustadt

[57] ABSTRACT

A flexible tank for liquids constructed from an inner layer of waterproof, thin-walled flexible polypropylene foil and an outer layer of flexible, highly compressed, tear-resistant polypropylene cloth. The construction provides a light weight tank which may be rolled up and easily transported. The tank is provided with an inlet and one or more large diameter (5 cm) outlet valves from which liquid in the tank may be dispensed without the use of a pump although a water or air pump may be used as an aid in dispensing the liquid. An insulating layer may be located above and/or below the tank or between the inner and outer layers. A heat absorbing layer may be placed above the tank and may be used in combination with an insulating layer under the tank. The tank may be provide with flow lines, valves and connectors for connection to other tanks to form a multiple arrangement of tanks.

21 Claims, 2 Drawing Sheets

FLEXIBLE TANK FOR LIQUIDS

BACKGROUND OF THE INVENTION

1. Field of the Invention

This invention concerns a tank for storing liquids and, more particularly, a flexible double-walled tank that is easily transportable when empty.

2. Discussion of the Background

Flexible tanks for liquids are generally known in the art and are principally used for mobile and temporary emergency purposes. Such tanks are therefore better suited for transportation than tanks with a defined, i.e., fixed shape. Tanks with a flexible outer tubular polypropylene cloth present a quasi-defined shape when filled. This shape is determined by the cut of the tubular polypropylene cloth and the kind of holding fixture used for the tank. It is observed that the material tensions in the tubular polypropylene cloth must remain within an admissible range under all operating conditions, since an excess material tension can lead to the tearing of the tubular polypropylene cloth. The areas of edges and corners of a tank are subject to material tensions, and these areas must be especially reinforced in the construction and manufacture of the tubular polypropylene cloth. The greater the tank's volume, the greater the forces attacking the tubular polypropylene cloth. Consequently, the requirements for stress capacity of the tank walls grow as well. The stress capacity of the tank walls can be raised by using a thicker material. However, this reduces the flexibility of the tank and some related advantages, such as easy transportability. Furthermore, processing of thicker wall materials cannot be effected with the same technologies as are suitable for the processing of thin flexible materials.

Tanks for liquids are generally hung in fixtures. For example, cylindrical tanks often are mounted to hang vertically in supporting devices. Such holding fixtures must be capable of supporting the entire weight of the full tank and have to be dimensioned correspondingly. Accordingly, the holding fixtures are bigger, more unwieldy, and heavier than desired and, in fact, are contradictory to the demand for a tank of low weight and easy transportability.

Consequently, there have been limits to the size of flexible tanks for liquids, i.e., the bigger the tank volume, the thicker and, therefore, stiffer must the tank walls be constructed and the heavier and bulkier are the holding fixtures. Thus, the advantageous features such as low weight and easy folding when empty and, consequently, good transportability, were lost.

SUMMARY OF THE INVENTION

According to an object of the present invention, the above-noted disadvantage can be compensated partly by producing a double wall for the tank including an inner polypropylene liner or foil, highly flexible and waterproof, which prevents the release of liquid, and an outer sheath around the polypropylene liner which absorbs the mechanical tensions caused by the load of the tank and protects the inner polypropylene liner against tearing and exterior damage. The outer sheath consists, according to a further object of the invention, of a highly tear-resistant fabric. The highly tear-resistant fabric is preferably highly compressed polypropylene cloth. Compared with thick foils, these fabrics also show a higher flexibility and resistance to wrinkling.

Another object of the invention is to create a flexible tank for liquids which can hold large amounts of liquid at a relatively low weight and can easily be transported. Such tanks can be used in wilderness areas for service in camps, for instance as water reservoirs or deposits for diesel fuel and many other liquids.

It is a further object of the invention to provide the tank with an insulating layer or layers and/or a heat absorbent layer or layers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
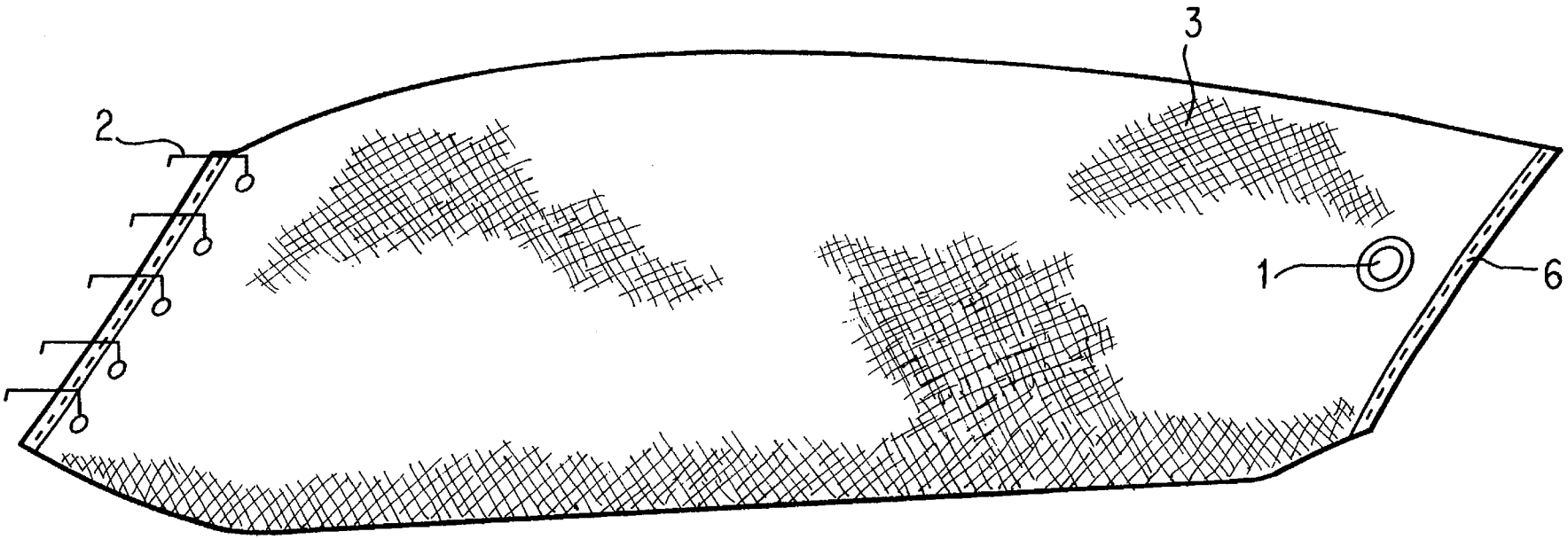
FIG. 1 shows a filled tank in perspective on a slightly inclined plane with one inlet valve and various outlet valves.

Referring now to the drawings, wherein like reference numerals designate identical or corresponding parts throughout both views, a longitudinally seamless tubular segment 4 made of liquid-resistant polypropylene liner or foil is sealed watertight on both ends by a weld seam (not shown). A tube-like section 3 made of highly tear-resistant polypropylene cloth or a similar fabric covers the liquid resistant tube-like polypropylene liner 4. The tube-like section 3 is sealed on both ends by seams 6. The fabric is sealed by either a welded seam or a sewing-seam and the polypropylene liner by a hot-welded seam. The use of tubular polypropylene cloth is of particular advantage, i.e., the polypropylene cloth, which is preferably highly compressed, is manufactured as a tube and has no longitudinal seams. Such seamless tubular segment of polypropylene cloth has a much higher tensile strength than similar cloth with longitudinal seams so that a thinner polypropylene cloth can be utilized in forming the outer sheath than would otherwise be needed. This feature complies with an object of the invention of weight reduction and ease of transportability of the tank. Moreover, the use of thinner polypropylene cloth leads to lower material costs, which are considerable because the material is very expensive.

The tank of the present invention is preferably used in the following manner. Before filling, the tank is placed flat on the ground. In the filling process the liquid spreads evenly over a large area, so that the resulting wall pressure on the tank walls remains low. The ground should have a slight inclination of preferably 0.5–5 degrees. The filling of the tank takes place ideally from the higher side of the tank through an inlet valve 1, whereas the outlet of the liquid can be arranged at the lower side.

When the tank is being used as a water deposit, several outlet valves 2 can be arranged for simultaneous use. If the water outlets should operate without a pump, i.e., if it flows out nearly without pressure, the outlet valves may have a large diameter. Furthermore, the water tank may have a very large discharge valve (not shown). This type of valve is useful if the tank must be transported quickly and therefore has to be emptied beforehand.

The slight inclination facilitates emptying of the tank. The discharge of the tank contents can be effected at the lower end with a water pump or at the upper end with an air pump. The pumps can be activated by hand, by means of a combustion engine, or also by means of a solar-cell fed electrical motor. The emptied tank can be rolled up without difficulty and without wrinkles. This feature also ensures very good transportability of the tank.

For its adaptation to different applications, the tank can be equipped with insulating layers. These insulating layers can be firmly connected to the outer wall of the tank or serve as mats or covers for the tank surface or lie under the tank. Moreover, the outer wall of the tank can be equipped with a heat-absorbent layer. This heat-absorbent layer can alternatively be firmly attached to the surface of the tank or be a removable cover. The insulating layer can also be placed between the outer, tear-resistant layer and the inner waterproof layer as shown at 5 in FIG. 2. The insulating layer and the heat-absorbent layer can also be applied in combination if this should be desirable. A tank may therefore lie with its underside on an insulating layer and the top of the tank may be fitted with a heat-absorbent layer. When the desired temperature increase has been reached, the tank can be covered with a heat-insulating layer in the form of a mat. The heat-insulating layer can also be a highly reflecting aluminum foil on a textile or similar carrier material. This is a simple way to control, within certain limits, the temperature of the tank contents.

The tank may also be equipped with flow lines, valves and connections for interconnecting the tank with other tanks to form a multiple arrangement of tanks.

In summary, a preferred embodiment of the invention is shown in FIG. 1. The outer sheath, made of a flexible, tear-resistant polypropylene fabric 3 is sealed at its ends with crosswise seams 6. The embodiment shown in FIG. 1 is a tank which serves as a water deposit. Because of its large dimensions (4 m×2.5 m×0.3 m) it has a capacity of 3 $m^3$ which is suitable for use as a supply for drinking and washing water in a camp. Through the inlet valve 1, rain and dew water may be introduced. The tapping takes place through outlet valves 2 with a diameter of approximately 5 cm. This large diameter is necessary because the water flows out nearly without pressure. The number of outlet valves is determined by the demand of water per time unit.

Figure 2:
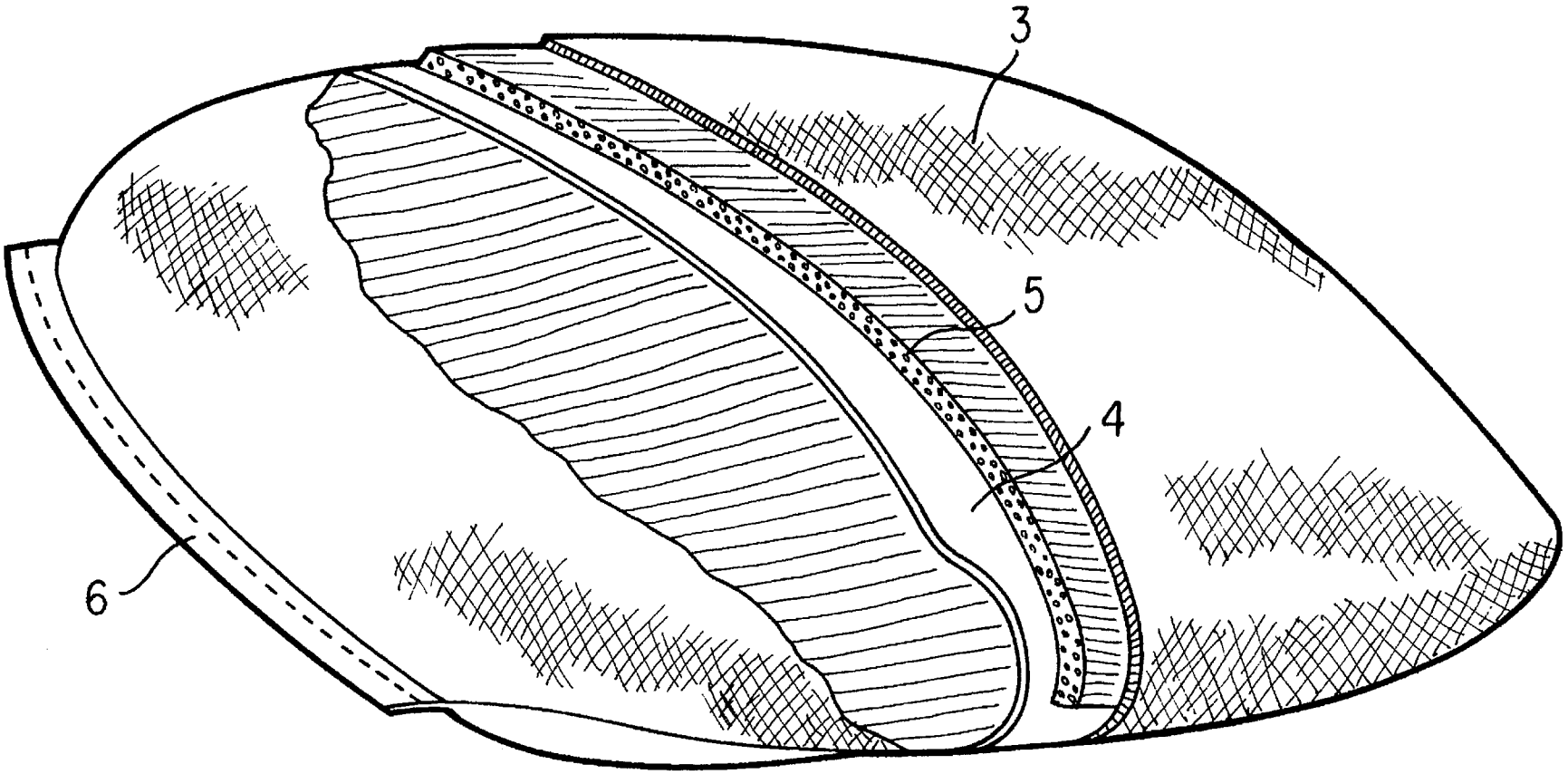
FIG. 2 shows the cross-section of a tank with a heat-insulating layer placed between a tube-shaped layer made of tear-resistant fabric and a tube-shaped waterproof inner layer.

Another preferred embodiment of the invention is shown in FIG. 2. An outer tank sheath 3 made of a tube-shaped, highly tear-resistant fabric covers a thin-walled polypropylene tube 4. A heat-insulating layer 5 is placed between the two. This heat-insulating layer 5 can, for example, protect a water tank against undesired cooling or a tank with diesel fuel against undesired cooling or undesired heating.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A flexible tank for liquids, comprising:

(a) an inner layer for retaining liquids within said tank, said inner layer comprising a first longitudinally seamless tubular segment of thin-walled, flexible foil and first means sealing the ends of said first tubular segment;

(b) an outer layer for reinforcing said inner layer, said outer layer comprising a second longitudinally seamless tubular segment of tear-resistant material and second means sealing the ends of said second tubular segment;

(c) insulating means associated therewith for reducing heat loss from the liquid in said tank, said insulating means comprising an upper insulating layer above said tank resting on said outer layer and a lower insulating layer below said tank with the bottom portion of said outer layer resting on said lower insulating layer, said insulating layer above said tank comprising aluminum foil.

2. A flexible tank according to claim 1, wherein said first tubular segment is made of polypropylene foil.

3. A flexible tank according to claim 1, wherein said first means comprises hot-weld seams.

4. A flexible tank according to claim 1, wherein said outer layer is made from tear-resistant and flexible material.

5. A flexible tank according to claim 1, wherein said outer layer is made from tear-resistant and flexible polypropylene material.

6. A flexible tank according to claim 1, wherein said outer layer is made of highly compressed and tear-resistant polypropylene cloth.

7. A flexible tank according to claim 1, wherein said second means comprise seams formed by sewing.

8. A flexible tank according to claim 1, wherein said second means comprise seams formed by welding.

9. A flexible tank according to claim 1, wherein said insulating means is removable from said tank.

10. A flexible tank according to claim 1, wherein said insulating means comprises an insulating layer positioned between said inner layer and said outer layer.

11. A flexible tank according to claim 1, wherein said tank is provided with an inlet opening and a plurality of outlet valves of up to 5 cm. in diameter.

12. A flexible tank for liquids, comprising:

(a) an inner layer for retaining liquids within said tank, said inner layer comprising a first longitudinally seamless tubular segment of thin-walled, flexible foil and first means sealing the ends of said first tubular segment;

(b) an outer layer for reinforcing said inner layer, said outer layer comprising a second longitudinally seamless tubular segment of tear-resistant material and second means sealing the ends of said second tubular segment;

(c) heat-absorbent means associated therewith for adding heat to the liquid in said tank, said heat absorbing means comprising a heat absorbing layer above said tank resting on said outer layer and wherein said tank further comprises an insulating layer associated therewith with the portion of said outer layer at the bottom of said tank resting on said insulating layer.

13. A flexible tank according to claim 12, wherein said heat-absorbent means is removable.

14. A flexible tank according to claim 12, wherein said first tubular segment is made of polypropylene foil.

15. A flexible tank according to claim 12, wherein said first means comprises hot-weld seams.

16. A flexible tank according to claim 12, wherein said outer layer is made from tear-resistant and flexible material.

17. A flexible tank according to claim 12, wherein said outer layer is made from tear-resistant and flexible polypropylene material.

18. A flexible tank according to claim 12, wherein said outer layer is made of highly compressed and tear-resistant polypropylene cloth.

19. A flexible tank according to claim 12, wherein said second means comprise seams formed by sewing.

20. A flexible tank according to claim 12, wherein said second means comprise seams formed by welding.

21. A flexible tank according to claim 12, wherein said tank is provided with an inlet opening and a plurality of outlet valves of up to 5 cm. in diameter.

* * * * *